United States Patent [19]

Tsuji

[11] Patent Number: 4,564,539

[45] Date of Patent: Jan. 14, 1986

[54] METAL MESH NETWORK

[75] Inventor: Tadashi Tsuji, Kyoto, Japan

[73] Assignee: Kabushiki Kaisha Tsuji, Kyoto, Japan

[21] Appl. No.: 614,463

[22] Filed: May 25, 1984

[51] Int. Cl.[4] ..... F16B 2/00

[52] U.S. Cl. ..... 428/33; 428/53; 428/256

[58] Field of Search ..... 428/33, 53, 256; 29/513

[56] References Cited

U.S. PATENT DOCUMENTS

| | | | |
|---|---|---|---|
| 689,232 | 12/1901 | Schoch | 428/52 |
| 1,883,214 | 10/1932 | Wilson et al. | 428/33 |
| 2,871,556 | 2/1959 | Chisholm | 29/513 |
| 4,229,496 | 10/1980 | Striegel | 428/53 |

*Primary Examiner*—James J. Bell

*Attorney, Agent, or Firm*—Koda and Androlia

[57] ABSTRACT

A metal mesh network, such as chain-mail, used for handbags, tapestries, vase mats, rugs, vests, etc. including unit piece members formed with pawls and joint ring members which are coated, before being formed, with a thermosetting acrylic resin paint, selected from epoxy type, ulethan type, and thermosetting acrylic type resin paints, over the entire surfaces. An assembling fixture for assembling the metal mesh network is a board formed on its surface with a plurality of square dents and posts. The unit piece members are placed in the dents of the fixture with the pawls up, and the joint ring members are put on the pawls. When the pawls are bent, the unit piece members are linked by the ring members to form chain-mail. With the unit piece members of different colors, ring members and the assembling fixture, one can readily form chain-mail of any size with any pattern on it.

11 Claims, 10 Drawing Figures

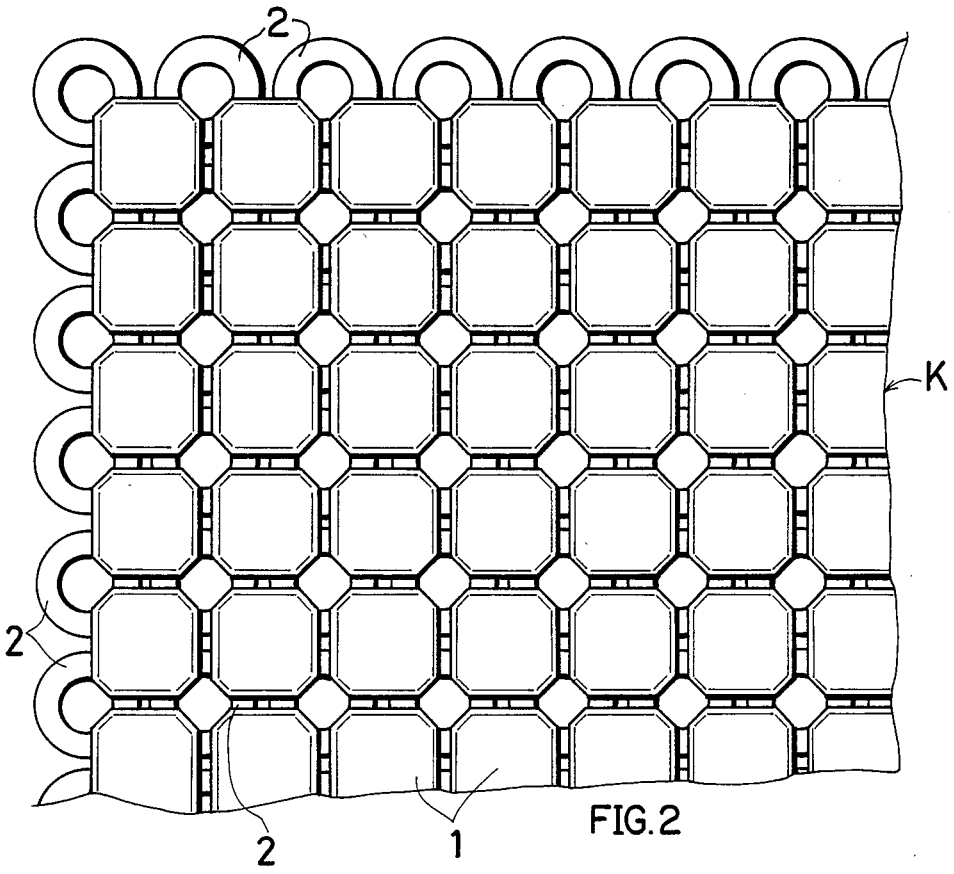
FIG. 2
FIG. 3
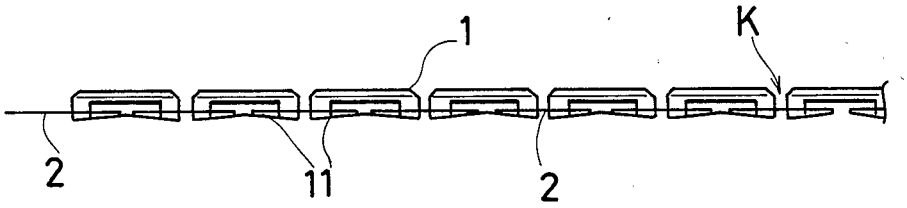

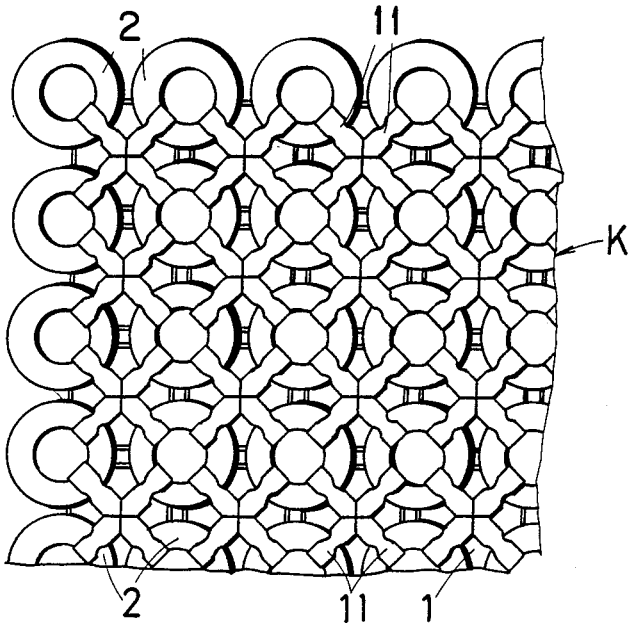
FIG. 4
FIG. 5
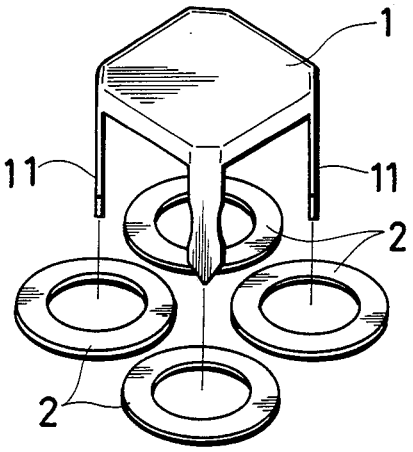

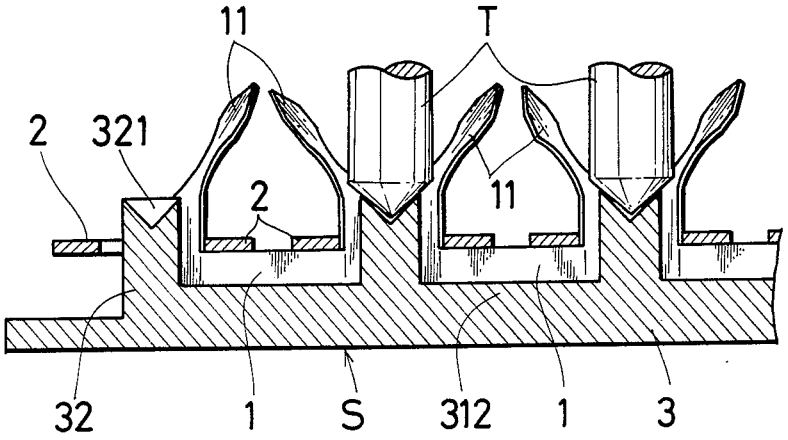
FIG.8(B)
FIG. 8 (C)
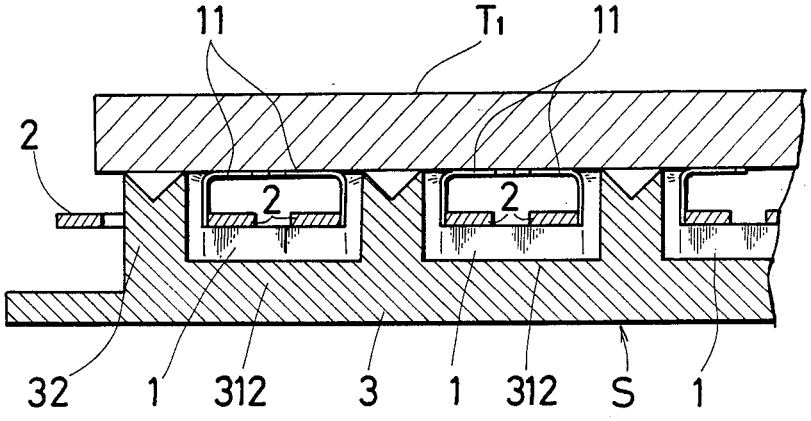

METAL MESH NETWORK

BACKGROUND OF THE INVENTION

1. Field of the Invention

This invention relates to a metal mesh network such as chain-mail to be applied to handbags, tapestries, rugs, vests, etc.

2. Prior Art

Metal mesh network (or, chain-mail) have been widely used for materials of women's handbags or other articles. Recently, various fashionable metal mesh networks have appeared on the market. The metal mesh network is composed of unit piece members which are made by shearing, pushing and bending a metal sheet such as an aluminum sheet, and joing ring members. Several pawls are set up on each piece member. The joint rings are loosely mounted over plural pawls of unit piece members adjajent to each other to bind the plural pawls and to bend the pawls outward opposite to each other. In this way plural unit piece members are connected to each other in the back-and-forth and right-and-left directions to form a cloth-like network.

Then this network is usually coated with proper paint and used as materials for handbags or other articles.

Since the conventional networks are coated with paint by spraying or other means after they have been assembled as described above, it is difficult to obtain metal mesh networks having complicated color patterns. Therefore, color patterns are restricted within monotone color patterns or two-tone color patterns made by masking. In addition, the pawls of the unit piece members are loosely fit in the ring members to provide flexibility to the metal mesh networks; accordingly, when the metal mesh network is spread, the unit piece members do not have equal intervals, so that it is almost impossible to paint all surfaces of the joint ring members which are exposed among unit piece members. Thus, some parts of the joint ring members remain unpainted. Even if all exposed surfaces of the joint ring members can be painted completely, some parts hidden by the unit piece members during painting may remain unpainted and may frequently appear during use since the joint ring members are rotatably engaged with the pawls. If silver or beige paint is used, the unpainted parts of the joint ring members are not so much conspicious. However, if a deep color such as black or red is used, the unpainted parts spoil the view and mar the appearance of the metal mesh networks.

SUMMARY OF THE INVENTION

It is therefore an object of the present invention to provide a metal mesh network, such as chain-mail, which is composed of unit piece members and joint ring members made of previously painted metal sheets to provide superior appearance and to allow any patterns to be formed as desired.

BRIEF DESCRIPTION OF THE DRAWINGS

FIG. 2 is a partially cutaway top view thereof;

FIG. 3 is a side view thereof;

FIG. 4 is a bottom view of the mesh network;

FIG. 5 is an enlarged perspective view of the unit piece member and joint ring member used for the metal mesh network of the present invention;

DETAILED DESCRIPTION OF THE INVENTION

Figure 1:
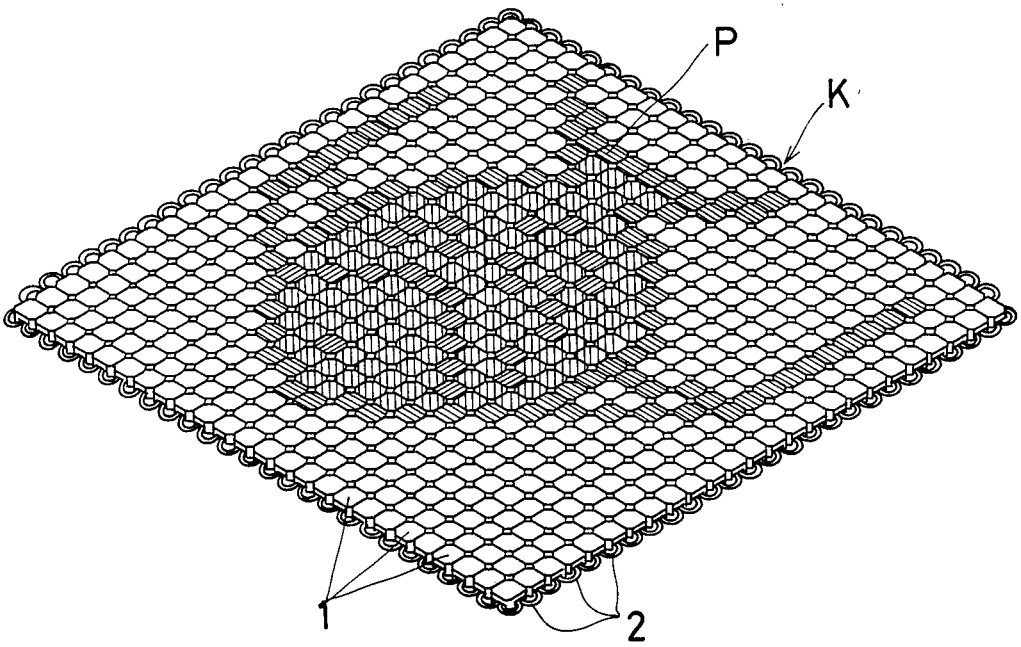
FIG. 1 is a perspective view of a typical metal mesh network of the present invention.

Referring now in detail to the drawings, a unit piece member 1 is made by shearing, punching and bending (partly drawing) a metal sheet made of aluminum, brass or steel. The unit piece member 1 has an almost square form, more accurately an octagonal form since its four corners are chamfered, and has a shape of a step including four pawls 11 with an equal length at its four corners. A joint ring member 2 is made of the same metal sheet as described above. The joint right member 2 has a hole which can loosely accomodate at least two pawls 11 of adjacent unit piece members 1 (at the fringe of a metal mesh network K) or at most four pawls 11 of adjacent unit piece members 1 (at the inside of the metal mesh network K). The unit piece members 1 are arranged adjacent to each other on a plane.

Plural pawls 11 facing each other (two pawls at the fringe and four pawls inside the metal mesh network K) are loosely inserted into a joint ring member 2. The pawls 11 are bent about 90° outward opposite to each other. In this way, the unit piece members 1 are connected by the joint ring members 2 as a cloth-like network to form a metal mesh network K. The unit piece members 1 can also have a triangular form with three pawls, provided that the unit piece members form repetitive arrangements when they are disposed on a plane. A metal sheet previously coated with resin paint is sheared, punched and bent (partially drawn at each peripheral edge and pawl) from one side of the sheet (from the uncoated side when only one side has been coated) to make the unit piece members 1. The joint ring members 2 are made by shearing and punching using an ordinary punching machine. The metal sheet is made of aluminum, brass or steel. However, an aluminum sheet is most preferable since it is light. A thermosetting arcylic resin paint (selected from epoxy type, ulethan type and thermosetting acrylic type resin paints) is used as a paint. to coat the metal sheet since it does not peel off or crack even when the sheet is sheared, punched and bent as described above.

Due to these features, the metal mesh network of the present invention can be used to form complicated patterns P which are almost impossible to be formed by the conventional method wherein paint is coated after a metal mesh network has been completed. In the case of the present invention, any complicated pattern P can be formed as desired according to designer's motif of using variously colored unit piece members 1 and joint ring members 2.

More specifically, if two groups of unit piece members 1 with different colors (and two groups of joint ring members 2 with different colors if required) are used, the pattern with clear contours described below can be formed on the metal mesh network K having any desired shapes and colors according to designer's motif.

If the number of groups with different colors increases, more diversified patterns can be formed. For example, FIG. 1 shows a fish pattern P (this fish pattern can be easily recognized when it is viewed from the right) which is made of three groups of unit piece members 1 with different colors: a light color (white in FIG. 1), an intermediate color (a color indicated by roughly slashed lines) and a deep color (a color indicated by densely slashed lines) and joint ring members 2. As shown by this pattern P, the background has a light color and the pattern P is formed by two groups of unit piece members 1 with an intermediate color and a deep color to make a two-tone color pattern. In this way, the shape arrangement, color coordination and color tint of the pattern P can be determined as desired according to designer's motif.

The joint ring members 2 are exposed around the fringe of the metal meshwork K as shown in FIG. 1. When a different color tone is desired between the joint ring members 2 and the background, joint ring members 2 with a color different from the color of the background are used as a matter of course. However, joint ring members 2 with the same color as the color of the ground can be used since the joint ring members 2 do not form the pattern P (most joint ring members 2 are hidden behind the metal mesh network).

In addition to the combination of a single kind of unit piece members 1, unit piece members of various shapes and colors can also be combined using the modified embodiment of the present invention, provided that the unit piece members have pawls which can be connected by joint ring members. By this kind of combination, the embodiment of the present invention can also be applied to mosaic decorations. Accordingly, the application range, which has been restricted in the case of conventional metal mesh networks, can be greatly extended using the embodiment of the present invention. As a result, the metal mesh network can be applied to handbags, tapestries, vase mats, seat covers, table covers, coasters, etc. They can also be applied to the material for vests. Unlike the joint ring members of the conventional metal mesh networks, the joint ring members of the present invention are painted before assembly, and do not have any unpainted portions. Therefore, the coordination between the unit piece members and the joint ring members is well maintained and the metal mesh networks with superior appearance can be obtained.

As described above, the metal mesh networks of the present invention are much more fashionable than the conventional metal mesh networks and thus the present invention is greatly valuable.

Next, the assembling fixture to assemble the metal mesh network K of the present invention is described below.

Figure 6:
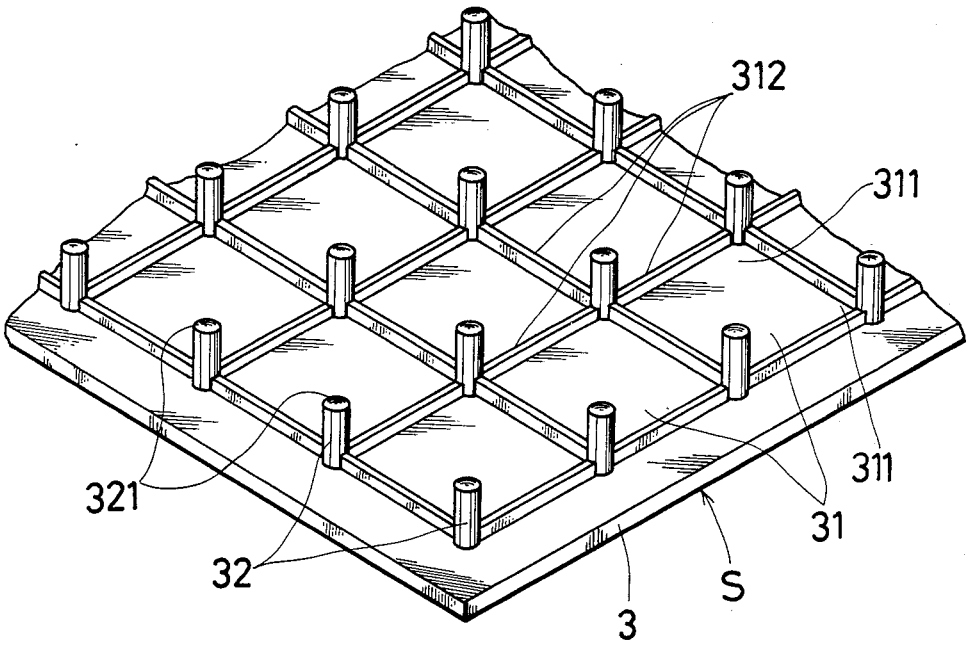
FIG. 6 illustrates an assembling fixture used to assemble the metal mesh network of the present invention.
Figure 7:
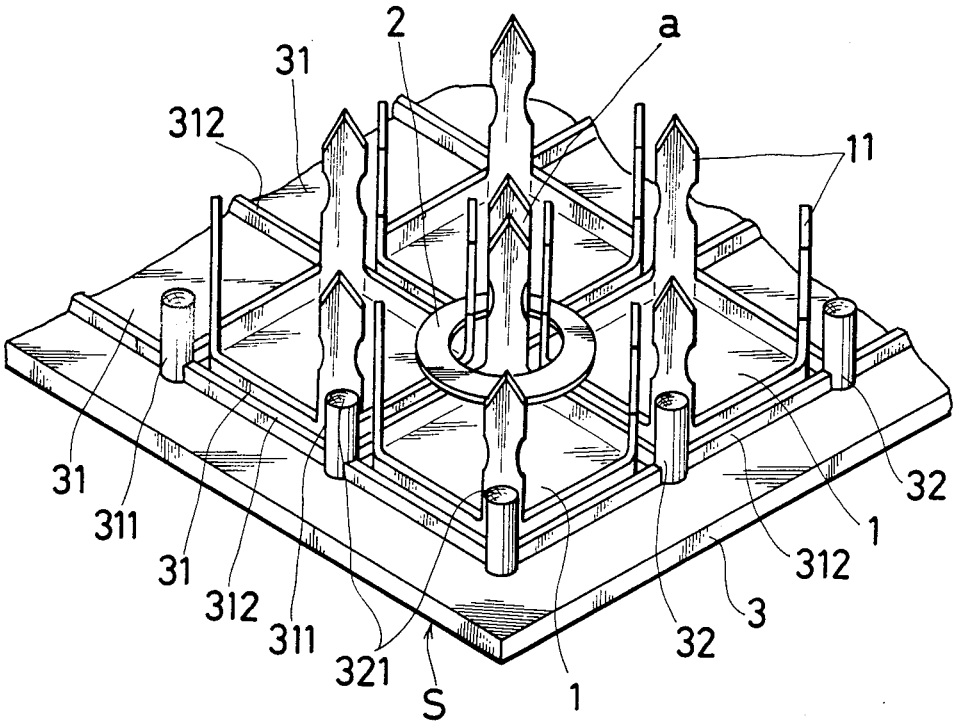
FIG. 7 is a perspective view illustrating the unit piece members fit in the assembling fixture.
Figure 8:
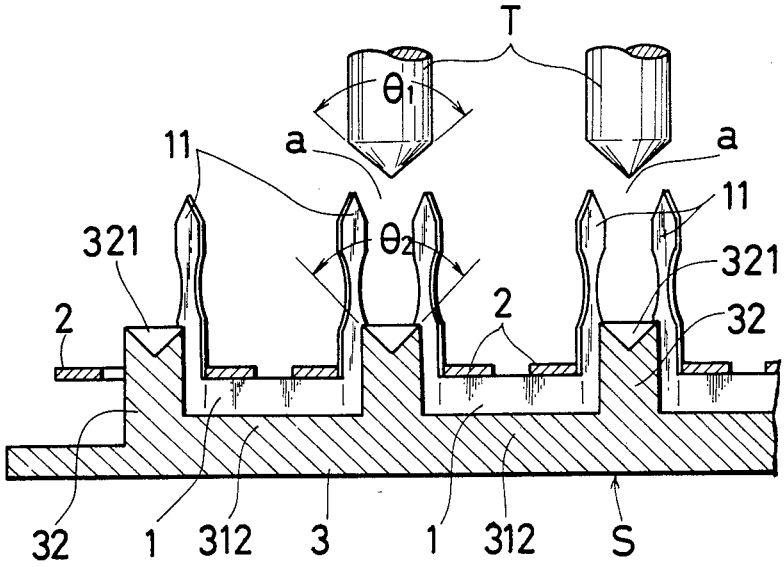
FIG. 8(A) is a longitudinal sectional side view thereof.
FIG. 8(B) is a longitudinal sectional side view illustrating tools being pushed onto the columns of the assembling fixture.
FIG. 8(C) is a longitudinal sectional side view illustrating a pressure plate being applied.

As shown in FIGS. 6, 7 and 8, this assembling fixture apparatus is composed of an assembly base S. The base S includes: a base plate 3 made of transparent synthetic resin with an appopriate elasticity; unit piece member accomodation hollows 31 which are formed adjacent to each other on the base plate 3 so that the unit piece members 1 are loosely fit in the hollows; columns 32 which are lower than the abovementioned pawls 11 and are provided at corners 311 of the unit piece member accommodation hollows 31; notches 321 which are formed on the tops of columns 32 to tightly hold tools T concentrically. The assembling fixture further includes tools T and a holder plate T1.

The base plate 3, partitions 312 and the columns 32 are all made of transparent resin, such as polyethylene, polyvinyl acetate or polyvinyl chloride. The unit piece member accomodation hollows 31 are adjacent to each other and separated by the partitions 312. In the case of the embodiment shown in FIGS. 6–8, the notch 321 provided on the top of the column 32 has a concave cone shape. The metal mesh network method using this fixutre is described below by referring to the drawings:

(i) Prepare various kinds of the unit piece members 1 and joint ring members 2 with various colors according to a desired design.

(ii) Place the assembly base S on a previously drawn pattern (not shown).

(iii) Loosely fit the square sections of the various unit piece members 1 in the accomodation hollows 31, according to the pattern which can be seen through the assembly base S, so that the pawls 11 contact the circumferences around the columns 32 of the assembly base 3 shown in FIG. 7. Since the assembly base S is made of an elastic synthetic resin, the unit piece members 1 can be stabily secured in the accomodation hollows 31.

(iv) Then, place the joint ring members 2 over the columns 32 so that the pawls 11 are loosely fit in the joint ring members 2 as shown in FIG. 7.

(v) Insert the column-shaped tool T into a space a formed by the pawls 11 to bend the pawls 11 of the unit piece members 1. The pawls are partially bent outward opposite to each other as seen in FIG. 8(A) and FIG. 8(B). The tool T has an appropriate diameter so that it can expand the pawls 11 (or so that it can bend the pawls 11 outward opposite to each other). The tool T is concentric to the notch 321 provided on the top of the column 32. The end of the tool is cone-shaped. The vertex angle $\theta 1$ of the tool T is slightly larger than the opposing angle $\theta 2$ of the concave cone-shaped notch 321.

(vi) After the step (v) is completed, press the pressure plate T1 down until it contacts the tops of the columns 32. The pawls 11 are fully bent as shown in Figure 8(C). By removing the pressure plate T1 and the assembly base S, the metal mesh network shown in FIGS. 2, 3 and 4 is obtained. The expression, "partially bend the pawls" seen in the step (v) means that the pawls 11 are slightly bent outward opposite to each other as shown in FIG. 8(B) so that when the partially bent pawls 11 are simultaneously pressed and fully bent by the pressure plate T1 in the step (vi), all the pawls are evenly bent almost 90° outward opposite to each other.

Since the assembling fixture has the construction described above, the unit piece members 1 can be arranged according to the pattern placed below. Therefore, the pattern of the metal mesh network can be made exactly identical to the original (or draft) pattern. Furthermore, since each unit piece member 1 is loosely fit in the accomodation hollow 31 of the base plate 3 made of elastic resin, it does not come off even when a slight shock is applied to the unit piece member 1 in the subsequent assembly process. The pawls 11 which contact the circumferences of the columns 32 are evenly bent outward opposite to each other when the tool T, which has a cone-shaped tip to tightly and concentrically fit the concave cone-shaped notch 321 provided on the top of the column 32, is pushed in the space between the two pawls 11 around the column 32.

The pawls 11 are further bent evenly at the same time outward opposite to each other when they are pressed by the pressure plate T1. If a non-concentric tool is used, or the pawls 11 are pressed by the pressure plate T1 before the pawls 11 are bent, the pawls 11 which contact the circumference of the column 32 may not always bend evenly outward opposite to each other. Accordingly, an aligned connection between the unit piece members 1 and the joint ring members 2 may not be obtained. In addition, since the vertex angle $\theta 1$ of the tool T is slightly larger than the opening angle $\theta 2$ of the notch 321, the tool T is tightly held in the notch 321 concentrically with the notch. Furthermore, since the pressure plate T1 evenly contacts the tops of the columns 32 to bend the pawls 11, excessive pushing and bending are prevented. Therefore, the pawls 11 are smoothly bent while they are loosely fit in the joint ring members 2 and the metal mesh network K can have a cloth-like flexibility. The bending work of this kind was conventionally done by hand. It was difficult to produce a large amount of networks if this work is done by an unskilled person. It is also difficult to obtain even bending of the pawls 11. This results in reduction of product value.

However, if the assembly base of the present invention is used, the assembly speed is increased twice or more and the productivity is greatly improved.

Although flat and square unit piece members are used in the drawings, they can also have a polygonal shape having pawls at each corner. In this case, the hollows and columns are arranged according to the shape as a matter of course. As described above, by using the metal mesh network assembling fixutre of the present invention, fashionable metal mesh networks can be easily made with special skills. As a result, productivity is improved and production cost is reduced. This combination of various unit piece members and the assembly base will surely mark a new phase in women's handicrafts.

Having described my invention as related to the embodiment shown in the accompanying drawings, it is my intention that the invention be not limited to any of the details of the description, unless otherwise specified, but rather construed broadly within its spirit and scope as set out in the accompanying claims.

I claim:

1. A metal mesh network comprising plural unit piece members made by shearing, punching and bending a metal sheet, each of which having plural pawls, and plural joint ring members made by punching said metal sheet, wherein:

said unit piece members are disposed adjacent to each other on a plane, and said plural pawls of said unit piece members, adjacent and facing with each other, are loosely fitted in each joint ring member and are bent outward opposite to each other so that said unit piece members are engaged with said joint ring members in a cloth-like form, said metal mesh network being characterized in that a metal sheet is first coated with thermosetting resin paint selected from epoxy type, urethane type and thermosetting acrylic type resin paints, then sheared, punched and bent to make said unit piece members and joint ring members so that said unit piece members and joint ring members are entirely coated with said resin paint.

2. A metal mesh network as claimed in claim 1, wherein said unit piece member is made of any aluminum, brass or steel sheet, has an almost square form, and has four pawls with an identical length at the corners, and said joint ring member is also made by said metal sheet and can loosely accommodate at least two or at most four pawls adjacent to each other.

3. A metal mesh network as claimed in claim 1 or 2, wherein a pattern is formed on a plane by any desired arrangement of said unit piece members which are identical in shape to but differ in color from those used in the background.

4. A metal mesh network as claimed in claim 3, wherein two or more patterns or formed.

5. A metal mesh network as claimed in claim 4, wherein the colors of said patterns differ from each other.

6. A metal mesh network as claimed in claim 1 or 2, wherein a pattern is formed on a plane by any desired arrangement of said unit piece members which are identical in shape and color with those used in the background.

7. A metal mesh network as claimed in claim 1 or 2, wherein said metal mesh network has a shape of a handbag, tapestry, vase mat, seat cover, coaster, table cover or vest.

8. A metal mesh network as claimed in claim 3, wherein said metal mesh network has a shape of a handbag, tapestry, vase mat, seat cover, coaster, table cover or vest.

9. A metal mesh network as claimed in claim 4, wherein said metal mesh network has a shape of a handbag, tapestry, vase mat, seat cover, coaster, table cover or vest.

10. A metal mesh network as claimed in claim 5, wherein said metal mesh network has a shape of a handbag, tapestry, vase mat, seat cover, coaster, table cover or vest.

11. A metal mesh network as claimed in claim 6, wherein said metal mesh network has a shape of a handbag, tapestry, vase mat, seat cover, coaster, table cover or vest.

* * * * *